US008616477B1

(12) United States Patent
Inman

(10) Patent No.: US 8,616,477 B1
(45) Date of Patent: Dec. 31, 2013

(54) WOOD CHIPPING APPARATUS, AND METHODS OF MAKING AND USING SAME

(76) Inventor: Albert J. Inman, Glennie, MI (US)

( * ) Notice: Subject to any disclaimer, the term of this patent is extended or adjusted under 35 U.S.C. 154(b) by 366 days.

(21) Appl. No.: 13/114,886

(22) Filed: May 24, 2011

(51) Int. Cl.
*B02C 19/00* (2006.01)
*B02C 23/00* (2006.01)
*B27C 1/00* (2006.01)

(52) U.S. Cl.
USPC ..... 241/55; 241/92; 241/101.76; 144/176

(58) Field of Classification Search
USPC ..... 241/55, 92, 300, 152.2, 298, 101.76; 144/176
See application file for complete search history.

(56) References Cited

U.S. PATENT DOCUMENTS

| | | | | |
|---|---|---|---|---|
| 3,844,489 | A | 10/1974 | Strong | |
| 4,770,217 | A | 9/1988 | Strong | |
| 4,827,989 | A | 5/1989 | Strong | |
| 5,060,873 | A | 10/1991 | Strong | |
| 5,358,189 | A * | 10/1994 | Vandermolen | 241/92 |
| 5,820,042 | A * | 10/1998 | Robison | 241/92 |
| 6,722,596 | B1 * | 4/2004 | Morey | 241/92 |
| 6,953,167 | B2 * | 10/2005 | Strong | 241/92 |
| 7,441,718 | B2 | 10/2008 | Seaman et al. | |
| 7,669,621 | B2 * | 3/2010 | Nettles et al. | 144/176 |
| 7,878,434 | B2 * | 2/2011 | Grant et al. | 241/37.5 |
| 7,896,268 | B2 * | 3/2011 | Robinson et al. | 241/55 |
| 8,051,887 | B2 * | 11/2011 | Robinson et al. | 144/373 |

* cited by examiner

*Primary Examiner* — Faye Francis
(74) *Attorney, Agent, or Firm* — Weiner & Burt, P.C.; Irving M. Weiner; Pamela S. Burt

(57) ABSTRACT

A wood chipping apparatus having: an hydraulic belt tensioner for gearbox to chipper wheel belts; hydraulic cylinders for adjusting belts from motor to gearbox; three wear plates in chip pockets; three wear plates on chipper base forming a semi-circle; and a gear to gear chipper chute rotation device.

20 Claims, 6 Drawing Sheets

FIG 10
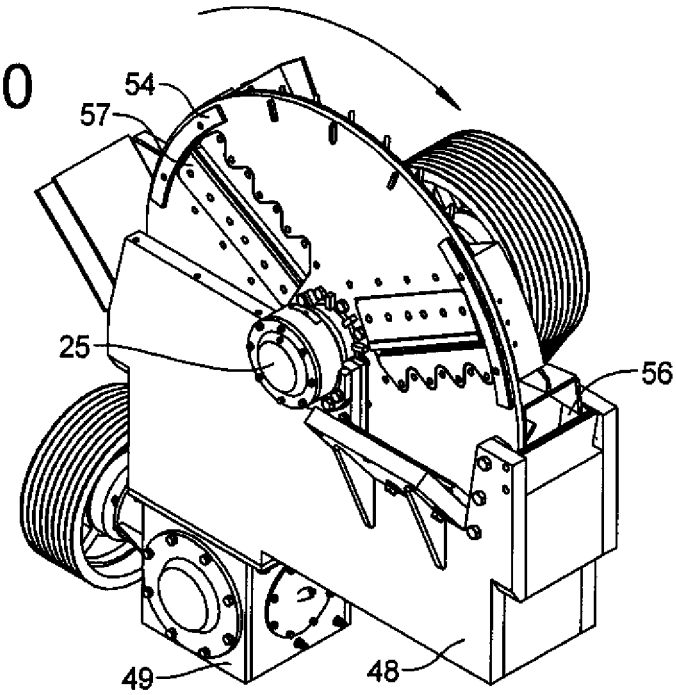
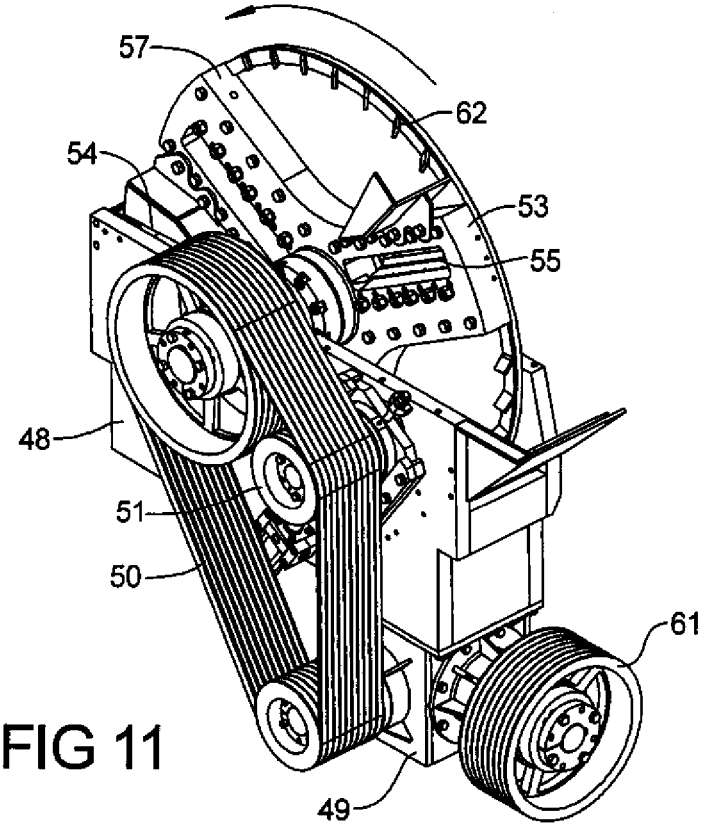
FIG 11

WOOD CHIPPING APPARATUS, AND METHODS OF MAKING AND USING SAME

The present invention relates generally to wood chipping apparatus, and methods of making and using same.

More particularly, the present invention relates to wood chipping apparatus which includes adjustable speed horizontal and vertical infeed rollers, and methods of making and using same.

BACKGROUND OF THE INVENTION

The prior, but not necessarily relevant, art is exemplified by the following U.S. Pat. Nos. Strong 4,770,217; Strong 4,827,989; Strong 5,060,873; and Seaman et al. 7,441,718.

It is a desideratum of the present invention to novel and unique wood chipping apparatus which avoids the animadversions of the prior art and wood chipping apparatuses.

SUMMARY OF THE INVENTION

The present invention provides a wood chipping apparatus comprising: a housing with an infeed mechanism for receiving material to be chipped and a peripheral wall with a discharge chute for expelling chips therefrom; said infeed mechanism including two powered horizontal rollers and two powered vertical rollers whereby said rollers have adjustable speeds to accommodate different chip sizes; a chipper disk element rotatably mounted on a drive shaft within said housing about an axis of rotation and having a peripheral edge spaced closely adjacent said peripheral wall; said chipping element including front and rear surfaces; said rear surface being located substantially in a plane; at least one knife for cutting said material to form wood chips; a plurality of fan blades for inducing an air flow which assists in moving the chips to the peripheral edge of said chipper disk element and peripheral wall out through said discharge chute for expelling chips therefrom; said perimeter of said chipper disk element being spaced from the perimeter of said housing providing a space therebetween through which chips can pass around said edge from said back side to said front side, as they are moved to the perimeter of said chipper disk element and housing by centrifugal force and said fan blades; at least one knife aperture for mounting said knife and through which chips pass from said front to said rear of said chipper disk element; said chipper disk element further including chip deflecting means mounted to said rear surface and arranged at an acute angle from said plane of said rear surface for deflecting wood chips in a direction along said axis of rotation of said disk away from the rear surface of said chipper disk element and away from the space between said edge and said peripheral wall to minimize the number of said chips passing over said edge to said front surface of said chipper element; said chipper disk element including a chipper base and chip pockets; said chipper base being provided with three replaceable wear plates forming a semi-circle; said chip pockets being provided with three replaceable wear plates; an engine connected to a gearbox by a first belt; hydraulic cylinders for adjusting said first belt; a second belt for connected between said gearbox and said chipping disk element; an hydraulic belt tensioner for tensioning said second belt; a power on demand hydraulic system; and said discharge chute includes an upper chute portion which can rotate relative to a lower chute portion by way of a gear-to-gear mechanism.

An object of the invention is to provide a wood chipping apparatus as described hereinabove including a chip separator mechanism for selectively diverting chips for landscaping to a lower outlet or diverting other chips to said discharge chute.

A further object of the invention is to provide a wood chipping apparatus as described hereinabove including a cutter bar attached to said drive shaft via a taper with no welding on said drive shaft.

Another object of the invention is to provide a wood chipping apparatus as described hereinabove including a movable plate to lock said discharge chute for transit.

A further object of the invention is to provide a wood chipping apparatus as described hereinabove wherein said chip separator mechanism is provided with a handle which selectively flips said chip separator mechanism open or closed as desired.

Another object of the invention is to provide a wood chipping apparatus as described hereinabove wherein said engine is provided with a radiator and a radiator fan which is hydraulically driven.

Further objects, advantages and features of the present invention will become apparent to those persons skilled in this particular area of technology and to others after being exposed to the following detailed specification and accompanying drawings.

BRIEF DESCRIPTION OF THE DRAWINGS

FIG. 10 is a perspective view of the chipper disk assembly from one side.

FIG. 11 is a perspective view of the chipper disk assembly from another side.

DETAILED DESCRIPTION OF THE PRESENT INVENTION

Figure 1:
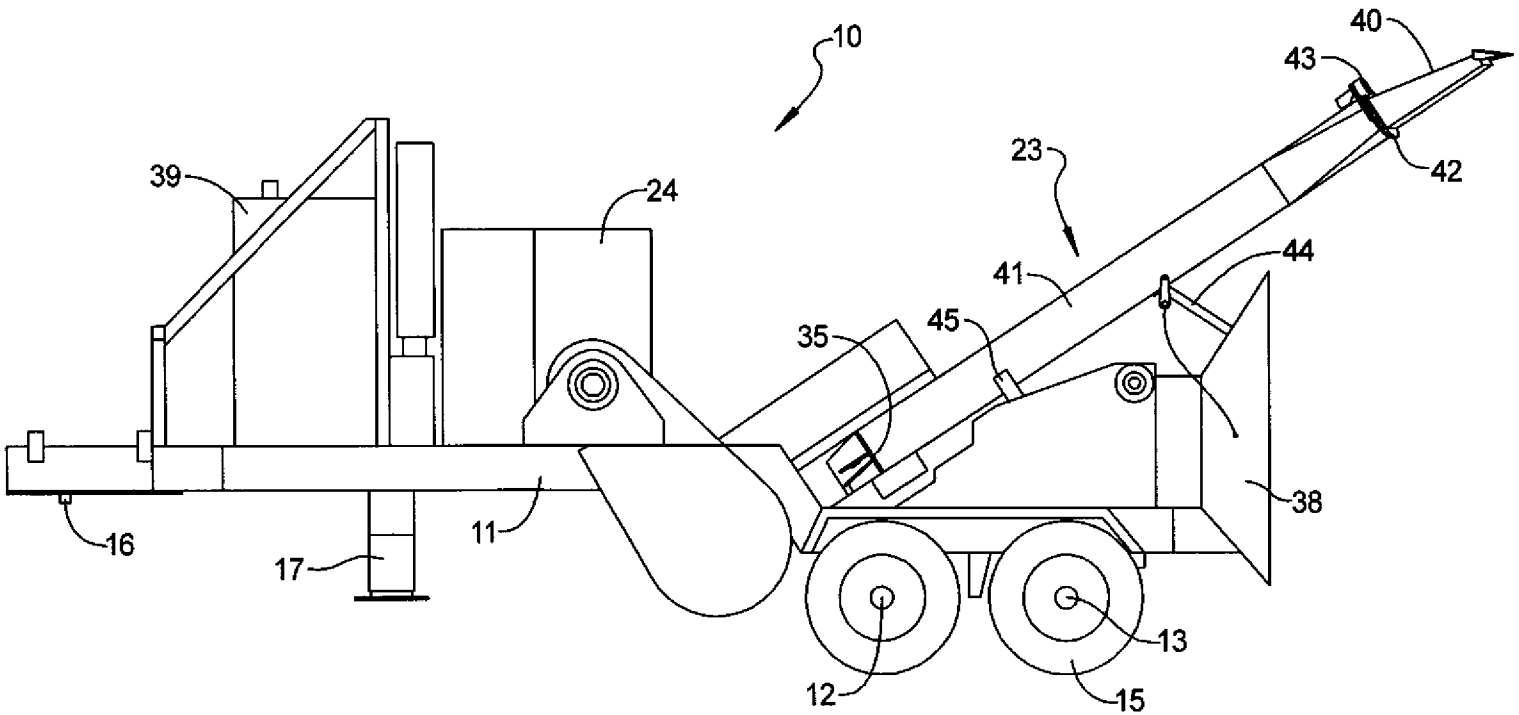
FIG. 1 is a left side elevational view of a wood chipping apparatus in accordance with a preferred embodiment of the present invention.
Figure 2:
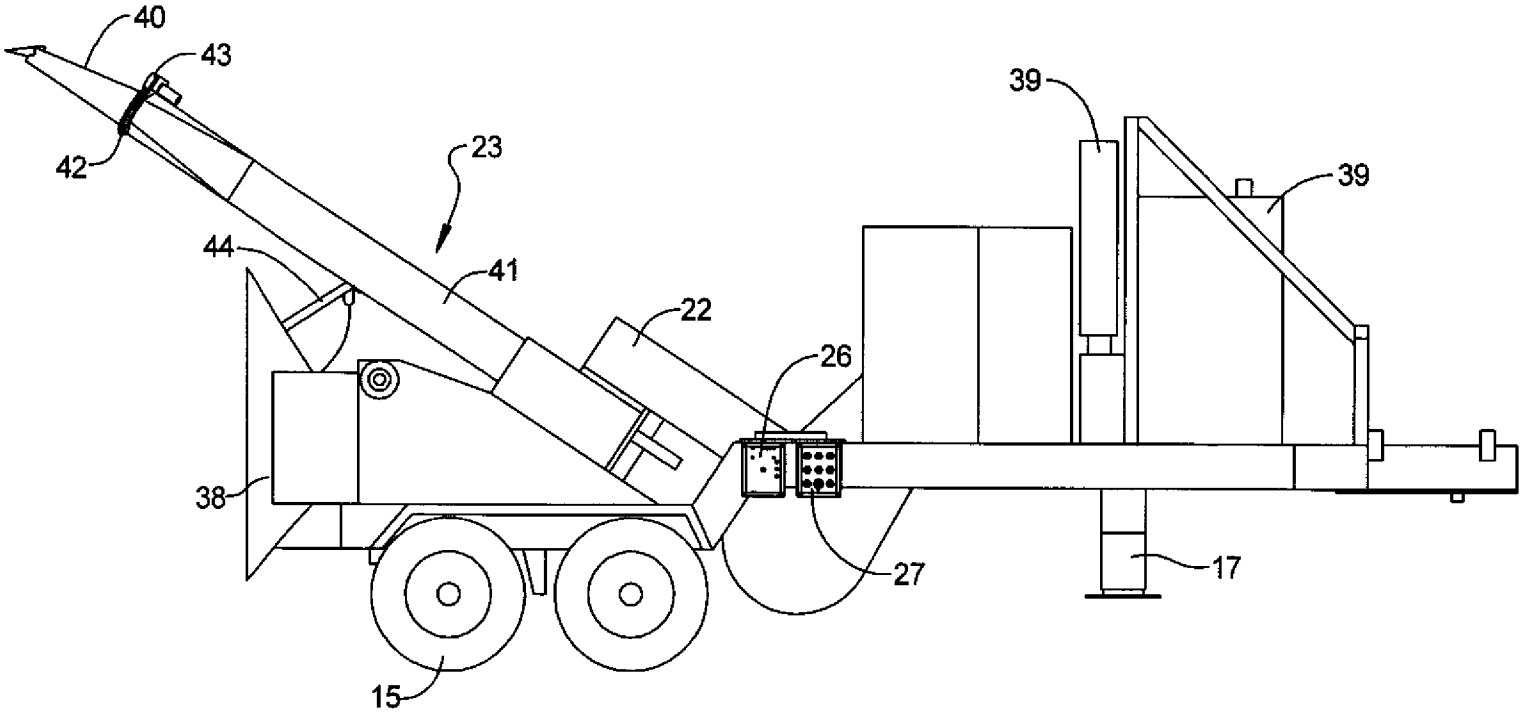
FIG. 2 is a right side elevational view of the FIG. 1 embodiment.
Figure 3:
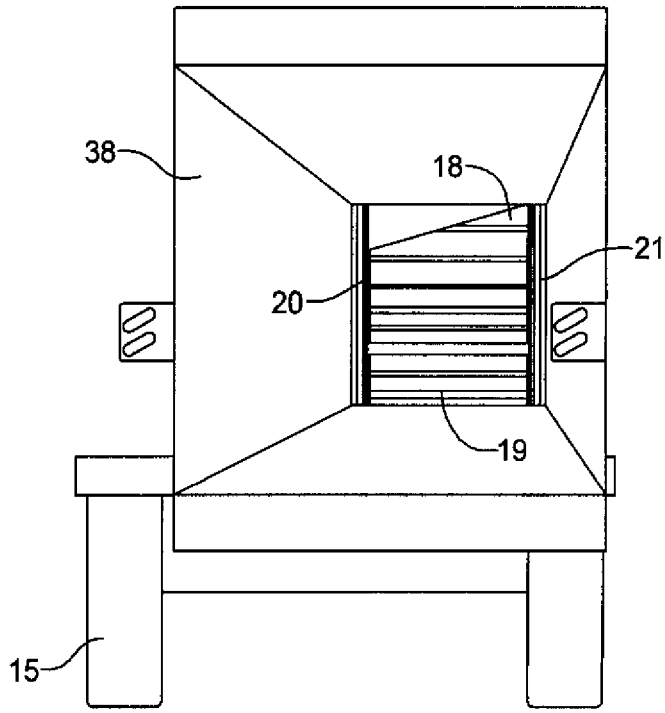
FIG. 3 is a rear elevational view of the FIG. 1 embodiment.

Referring to FIGS. 1-3, there is shown a portable wood chipping apparatus 10 comprising a trailer 11 having a frame mounted on a pair of axles 12 and 13 with wheels 15.

Suitable hitch means 16 are provided for coupling the trailer to a towing vehicle to transport the wood chipper.

The trailer 11 includes a retractable stand 17 which can be lowered to support the trailer 11 such that the towing vehicle can be removed if desired when the chipper apparatus 10 is in use.

The wood chipping apparatus 10 further includes feed means such as a belt conveyor which is supported between two pairs of rollers 18, 19, 20 and 21 (see FIG. 3) to transport a log, branches, or other wood material into the chipping apparatus 10.

Positioned at the output end of the conveyor is the wood chipper 22 which comprises a chipper housing which encloses the rotating portions of the wood chipper 22 and provides controlled discharge of the wood chips from the discharge chute 23.

The wood chipper 22 is oriented an angle of 34 degrees to 50 degrees, but preferably 37 degrees, relative to the horizontal.

A power drive means such as a gasoline or diesel powered engine 24 is positioned to be coupled to a drive shaft 25 of the wood chipper 22 via an input sheave 61 belted to the engine 24.

As shown in FIG. 3, the infeed mechanism 38 including two powered horizontal rollers 18 and 19 and two powered vertical rollers 20 and 21 whereby the rollers 18, 19, 20 and 21 have adjustable speeds to accommodate different chip sizes.

More particularly, the wood chipping apparatus 10 includes: the engine 24; the radiator 39 for the engine 24; a combined fuel/hydraulic tank 39; a housing with the infeed mechanism 38 for receiving material to be chipped and a peripheral wall with the discharge chute 23 for expelling chips therefrom; the chipping assembly 22; an hydraulic belt tensioner 46; the discharge chute 23 includes an upper chute portion 40 which can rotate relative to a lower chute portion 41 by way of a gear-to-gear mechanism 42 driven by an hydraulic gear drive 43; a chute carrier 44; a movable plate 45 to lock the discharge chute 23 for transit.

Figure 4:
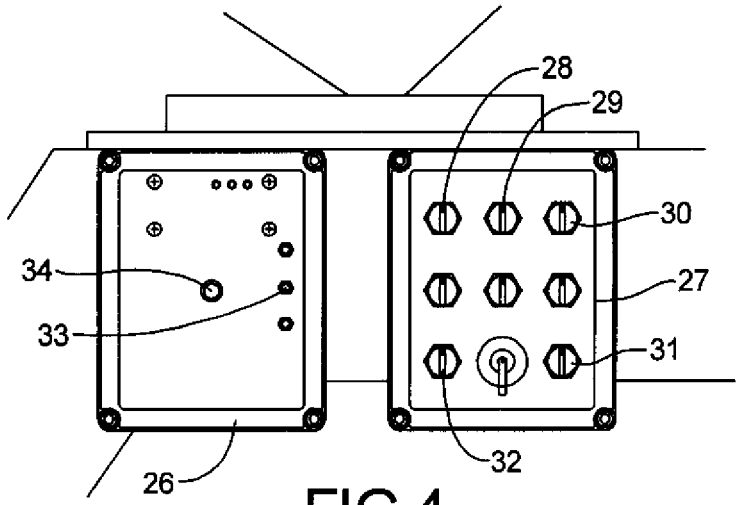
FIG. 4 illustrates a control panel for the FIG. 1 embodiment.

FIG. 4 shows the control panels 26 and 27 which include all the controls and warning lights, such as, for example, a feed arm control switch 28, a feed rollers control switch 29, a stabilizer leg control switch 30, a throttle control switch 31, a clutch control switch 32, a feed wheel speed control switch 33, a clutch warning light 34, etc.

Figure 5:
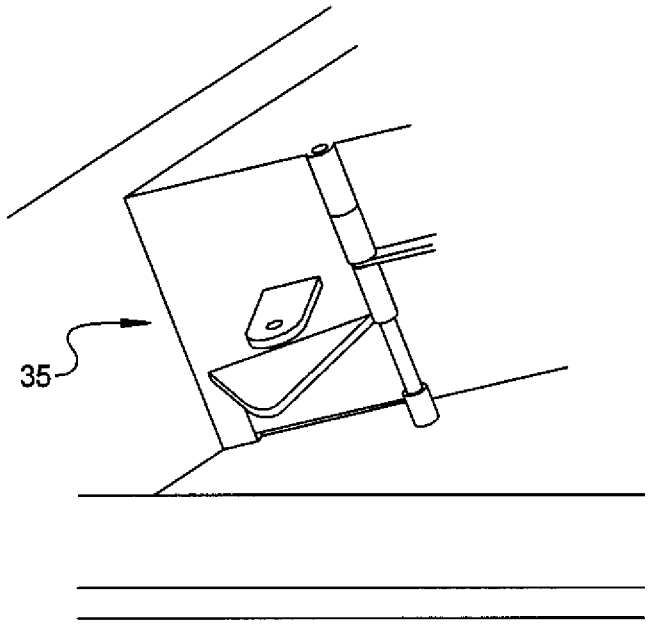
FIG. 5 is a view of the chip separator mechanism showing the lower outlet in the closed position.
Figure 6:
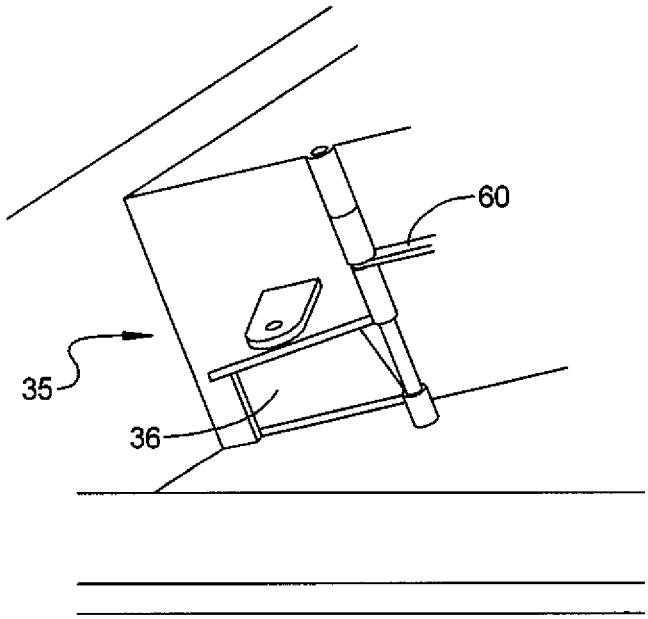
FIG. 6 is a view of the chip separator mechanism showing the lower outlet in the open position.

FIGS. 5 and 6 show the chip separator mechanism 35 for selectively diverting chips for landscaping to a lower outlet 36 or diverting other chips to the discharge chute 23.

The mechanism 35 is operated by a handle 60.

In the FIG. 5 position, the chips are propelled out the main discharge chute 23.

In the FIG. 6 position, better quality chips (such as for landscaping) are diverted out the lower outlet 36.

Figure 7:
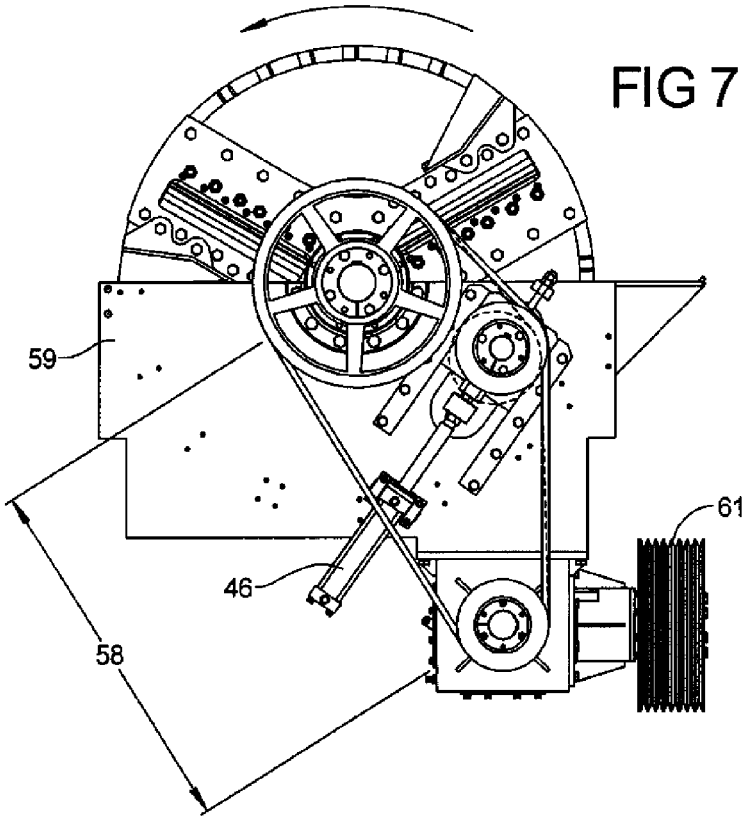
FIG. 7 shows the chipper disk assembly.

FIG. 7 shows the chipper disk assembly 22 and the hydraulic belt tensioner 46.

Figure 8:
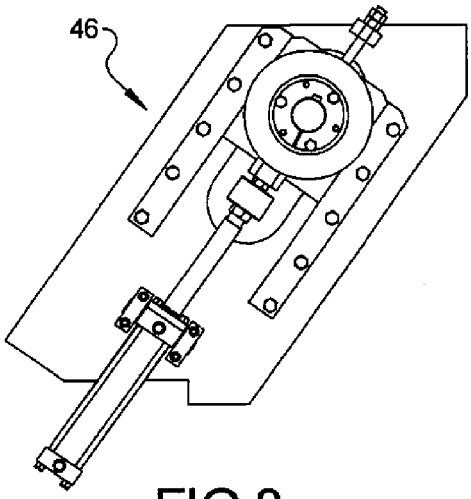
FIG. 8 shows the hydraulic belt tensioner in one position.

FIG. 8 shows the hydraulic belt tensioner 46 in an extended position.

Figure 9:
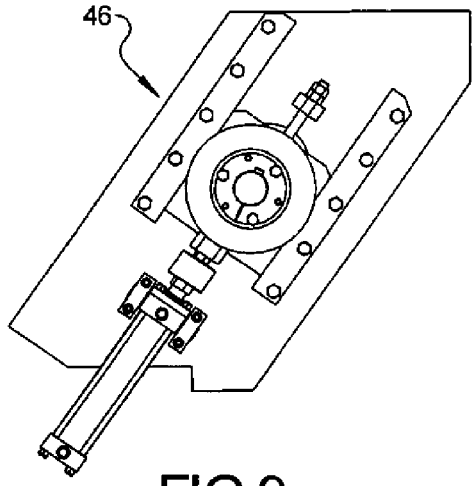
FIG. 9 shows the hydraulic belt tensioner in another position.

FIG. 9 shows the hydraulic belt tensioner 46 in a contracted position.

FIGS. 10 and 11 are perspective views of the chipper disk assembly 22.

The chipper disk assembly 22 includes the input sheave 47 belted to the motor or engine 24, the chipper case assembly 48, the gear box assembly 49, ten belts 50, the hydraulic belt tensioner 46, the idler sheave assembly 51, a chipper disk element 52 rotatably mounted on the drive shaft 25 having a peripheral edge spaced closely adjacent the peripheral wall, three knife assemblies 53, three replaceable wear plates 54 on the outside of respective pockets 55, a 4-inch strip wear plate 56, and the cutter bar 57.

The hydraulic belt tensioner 46 may have a minimum pressure of 340 psi, and a maximum pressure of 460 psi.

The hydraulic pressure is adjusted to obtain a deflection of 0.83 inches measured at the middle of belt span 58.

The cutter bar 57 is attached to the shaft 25 via taper with no welding on the shaft 25.

The bolt holes 59 for the wear plates 54 are shown in FIG. 7.

The chip separator of the present invention includes chip deflecting means in the form of a series of angled fins 62 (FIG. 11) which are welded to the chipper disk element 52.

While the invention can function with at least a pair of fins 62, the invention is preferably practiced with a plurality of equally-spaced fins 62.

Each fin 62 can be set at an angle in a range of from about 10 degrees to 170 degrees, but preferably is set at about 45 degrees.

While the present invention has been described in detail with reference to only one particular embodiments thereof, it should be understood that this has been described by way of illustration only, and not by way of limitation.

Reasonable variation and modification are possible within the spirit of the foregoing specification and drawings without departing from the scope of the invention which is defined in the accompanying claims.

The present invention embraces all embodiments, modifications, variations and changes which come within the scope of the patent claims set forth hereinbelow.

The invention claimed is:

1. A wood chipping apparatus comprising:

a housing with an infeed mechanism for receiving material to be chipped and a peripheral wall with a discharge chute for expelling chips therefrom;

said infeed mechanism including two powered horizontal rollers and two powered vertical rollers whereby said rollers have adjustable speeds to accommodate different chip sizes;

a chipper disk element rotatably mounted on a drive shaft within said housing about an axis of rotation and having a peripheral edge spaced closely adjacent said peripheral wall;

said chipping element including front and rear surfaces;

said rear surface being located substantially in a plane;

at least one knife for cutting said material to form wood chips;

a plurality of fan blades for inducing an air flow which assists in moving the chips to the peripheral edge of said chipper disk element and peripheral wall out through said discharge chute for expelling chips therefrom;

said perimeter of said chipper disk element being spaced from the perimeter of said housing providing a space therebetween through which chips can pass around said edge from said back side to said front side, as they are moved to the perimeter of said chipper disk element and housing by centrifugal force and said fan blades;

at least one knife aperture for mounting said knife and through which chips pass from said front to said rear of said chipper disk element;

said chipper disk element further including chip deflecting means mounted to said rear surface and arranged at an acute angle from said plane of said rear surface for deflecting wood chips in a direction along said axis of rotation of said disk away from the rear surface of said chipper disk element and away from the space between said edge and said peripheral wall to minimize the number of said chips passing over said edge to said front surface of said chipper element;

said chipper disk element including a chipper base and chip pockets;

said chipper base being provided with three replaceable wear plates forming a semi-circle;

said chip pockets being provided with three replaceable wear plates;

an engine connected to a gearbox by a first belt;

hydraulic cylinders for adjusting said first belt;

a second belt for connected between said gearbox and said chipping disk element;

an hydraulic belt tensioner for tensioning said second belt;

a power on demand hydraulic system; and said discharge chute includes an upper chute portion which can rotate relative to a lower chute portion by way of a gear-to-gear mechanism.

2. The apparatus of claim 1, including:

a chip separator mechanism for selectively diverting chips for landscaping to a lower outlet or diverting other chips to said discharge chute.

3. The apparatus of claim 1, including:

a cutter bar attached to said drive shaft via a taper with no welding on said drive shaft.

4. The apparatus of claim 2, including:

a cutter bar attached to said drive shaft via a taper with no welding on said drive shaft.

5. The apparatus of claim 1, including:

a movable plate to lock said discharge chute for transit.

6. The apparatus of claim 2, including:

a movable plate to lock said discharge chute for transit.

7. The apparatus of claim 3, including:

a movable plate to lock said discharge chute for transit.

8. The apparatus of claim 4, including:

a movable plate to lock said discharge chute for transit.

9. The apparatus of claim 2, wherein:

said chip separator mechanism is provided with a handle which selectively flips said chip separator mechanism open or closed as desired.

10. The apparatus of claim 4, wherein:

said chip separator mechanism is provided with a handle which selectively flips said chip separator mechanism open or closed as desired.

11. The apparatus of claim 6, wherein:

said chip separator mechanism is provided with a handle which selectively flips said chip separator mechanism open or closed as desired.

12. The apparatus of claim 8, wherein:

said chip separator mechanism is provided with a handle which selectively flips said chip separator mechanism open or closed as desired.

13. The apparatus of claim 1, wherein:

said engine is provided with a radiator and a radiator fan which is hydraulically driven.

14. The apparatus of claim 2, wherein:

said engine is provided with a radiator and a radiator fan which is hydraulically driven.

15. The apparatus of claim 3, wherein:

said engine is provided with a radiator and a radiator fan which is hydraulically driven.

16. The apparatus of claim 4, wherein:

said engine is provided with a radiator and a radiator fan which is hydraulically driven.

17. The apparatus of claim 5, wherein:

said engine is provided with a radiator and a radiator fan which is hydraulically driven.

18. The apparatus of claim 6, wherein:

said engine is provided with a radiator and a radiator fan which is hydraulically driven.

19. The apparatus of claim 7, wherein:

said engine is provided with a radiator and a radiator fan which is hydraulically driven.

20. The apparatus of claim 12, wherein:

said engine is provided with a radiator and a radiator fan which is hydraulically driven.

* * * * *